US007273094B2

(12) United States Patent
Lin

(10) Patent No.: US 7,273,094 B2
(45) Date of Patent: Sep. 25, 2007

(54) COOLING FIN UNIT

(75) Inventor: Sheng-Huang Lin, Taipei (TW)

(73) Assignee: Asia Vitag Components Co. Ltd., Kaohsiung ( * ) Notice: Subject to any disclaimer, the term of this patent is extended or adjusted under 35 U.S.C. 154(b) by 63 days.

(21) Appl. No.: 11/189,949

(22) Filed: Jul. 27, 2005

(65) Prior Publication Data

US 2007/0023178 A1 Feb. 1, 2007

(51) Int. Cl.
*F28F 1/22* (2006.01)

(52) U.S. Cl. ..... 165/182; 165/80.3

(58) Field of Classification Search ..... 165/80.3, 165/104.21, 104.33, 181, 182
See application file for complete search history.

(56) References Cited

U.S. PATENT DOCUMENTS 1,787,942 A * 1/1931 Kalloch ..... 165/181
1,992,646 A * 2/1935 Young ..... 165/182
2,475,604 A * 7/1949 Frisch et al. ..... 165/176
2,482,595 A * 9/1949 Plum ..... 165/182
5,582,244 A * 12/1996 Helms et al. ..... 165/151
6,382,307 B1 * 5/2002 Wang et al. ..... 165/80.3
2006/0144580 A1 * 7/2006 Wang ..... 165/182

* cited by examiner

*Primary Examiner*—Teresa J. Walberg

(57) ABSTRACT

A cooling fin unit includes a plurality of cooling fins and a heat guide pipe. Each of the cooling fins has a through hole at the main body thereof and the heat guide pipe passes through the through hole respectively. A recess part is provided to indent toward a side of the main body near the outer side of the through hole and the recess part has a receiving space communicating with the through hole. A heat conductive medium, which is received in the receiving space, is heated up to become a state of melting to fill with spots between the outer surface of the heat guide pipe and the respective through hole.

1 Claim, 4 Drawing Sheets

COOLING FIN UNIT

BACKGROUND OF THE INVENTION

1. Field of the Invention

The present invention is related to a cooling fin unit and particularly to a cooling fin unit joined to a heat guide pipe.

2. Brief Description of the Related Art

In order to increase heat dissipation rate of a cooling fin set, a heat guide pipe is provided to pass through the cooling fin set. There is provided with capillary mechanism and work fluid in the heat guide pipe to perform heat exchange with the cooling fin set for removing heat from the cooling fin set speedily.

The conventional cooling fin set provides a through hole at each of the cooling fins thereof with a hole diameter being the same as or less than the outer diameter of the heat guide pipe for the heat guide pipe tightly fit with the through hole respectively.

The inner wall of the through hole or the outer surface of the heat guide pipe is coated with a layer of heat conductive medium such as heat conductive glue or soldering paste before the heat guide pipe passing through the cooling fin. The heat conductive medium is used for increasing heat transfer efficiency and binding the through holes and the heat guide pipe together firmly.

However, the coated soldering paste is scratched and accumulates at a lateral side of the respective cooling fins near border of the through hole during the heat guide pipe passing through the cooling fin set. Under this circumference, the heat conductive medium is unable to distribute between the through hole and the heat guide pipe completely and deprive function and purpose of the heat conductive medium.

The preceding conventional structure is disclosed in such as Taiwanese Patent Publication No. 518927 and 547002.

SUMMARY OF THE INVENTION

In order to solve the preceding problems, an object of the present invention is to provide a cooling fin unit in which at least a cooling fin has at least a recess part near a through hole to indent toward a side thereof and the recess part has a receiving space and communicates with the through hole for placing a heat conductive medium.

Accordingly, a cooling fin unit according to the present invention includes a plurality of cooling fins and a heat guide pipe. Each of the cooling fins has a through hole at the main body thereof and the heat guide pipe passes through the through hole respectively. A non-penetrating recess part is provided to indent toward a side of the main body near the outer side of the through hole and the recess part has a receiving space communicating with the through hole. A heat guide medium, which is received in the receiving space, is heated up to become a state of melting to fill with spots between the outer surface of the heat guide pipe and the respective through hole.

BRIEF DESCRIPTION OF THE DRAWINGS

The detail structure, the applied principle, the function and the effectiveness of the present invention can be more fully understood with reference to the following description and accompanying drawings, in which.

DETAILED DESCRIPTION OF THE INVENTION

Figure 1:
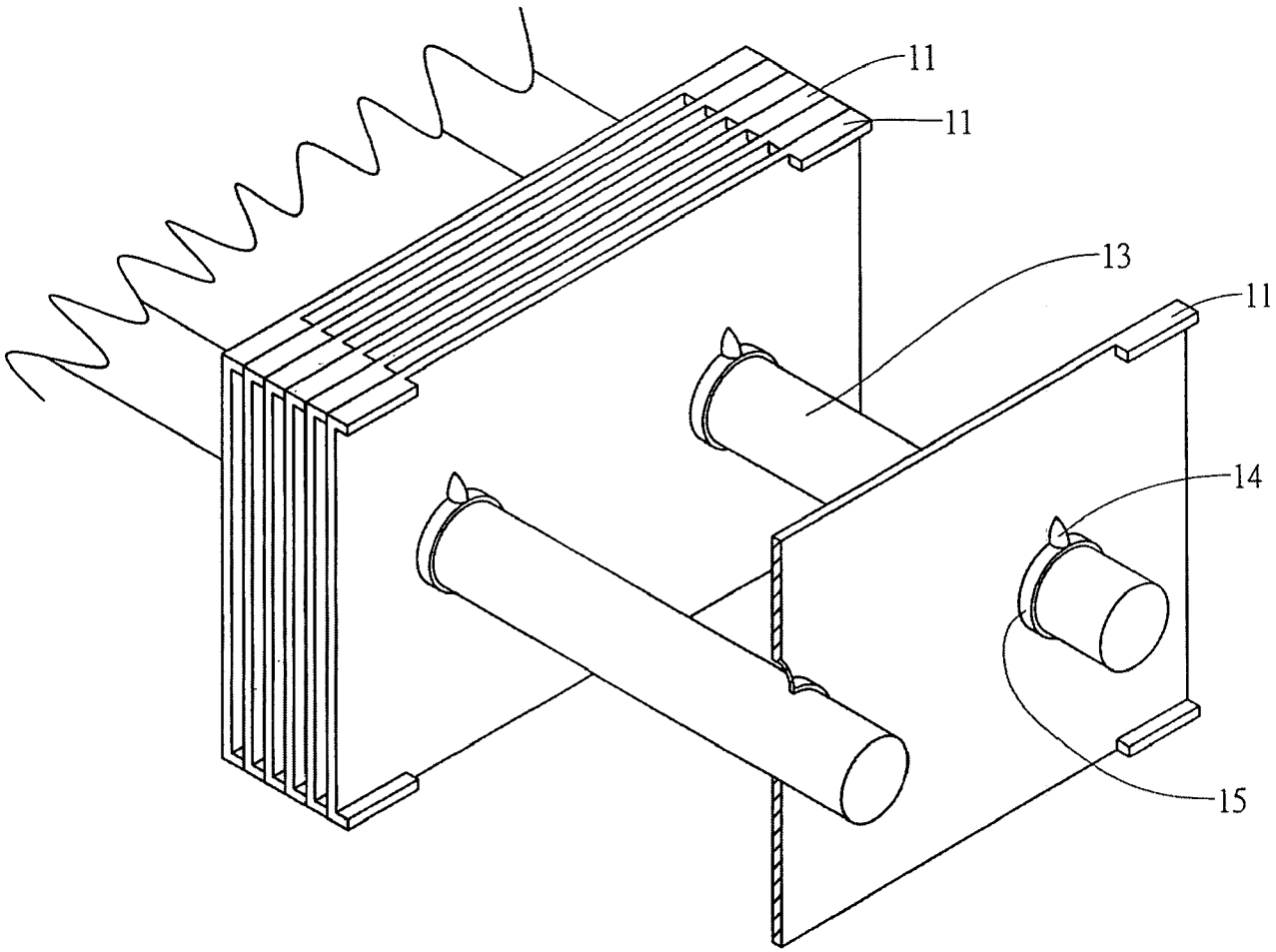
FIG. 1 is a perspective view of a cooling fin unit according to the present invention.
Figure 3:
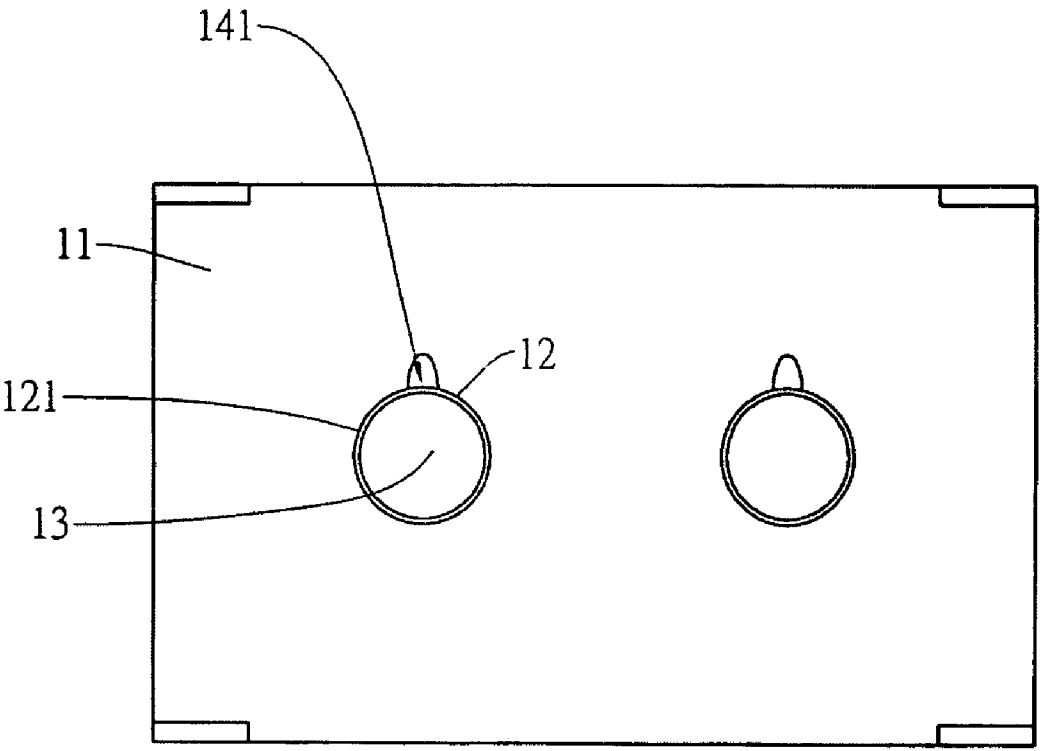
FIG. 3 is a front view of the cooling fin unit of the present invention with a heat guide pipe.
Figure 2:
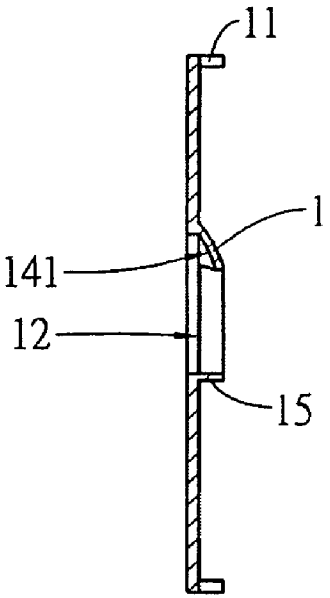
FIG. 2 is a sectional view of a single cooling fin in the cooling fin unit according the present invention.
Figure 4:
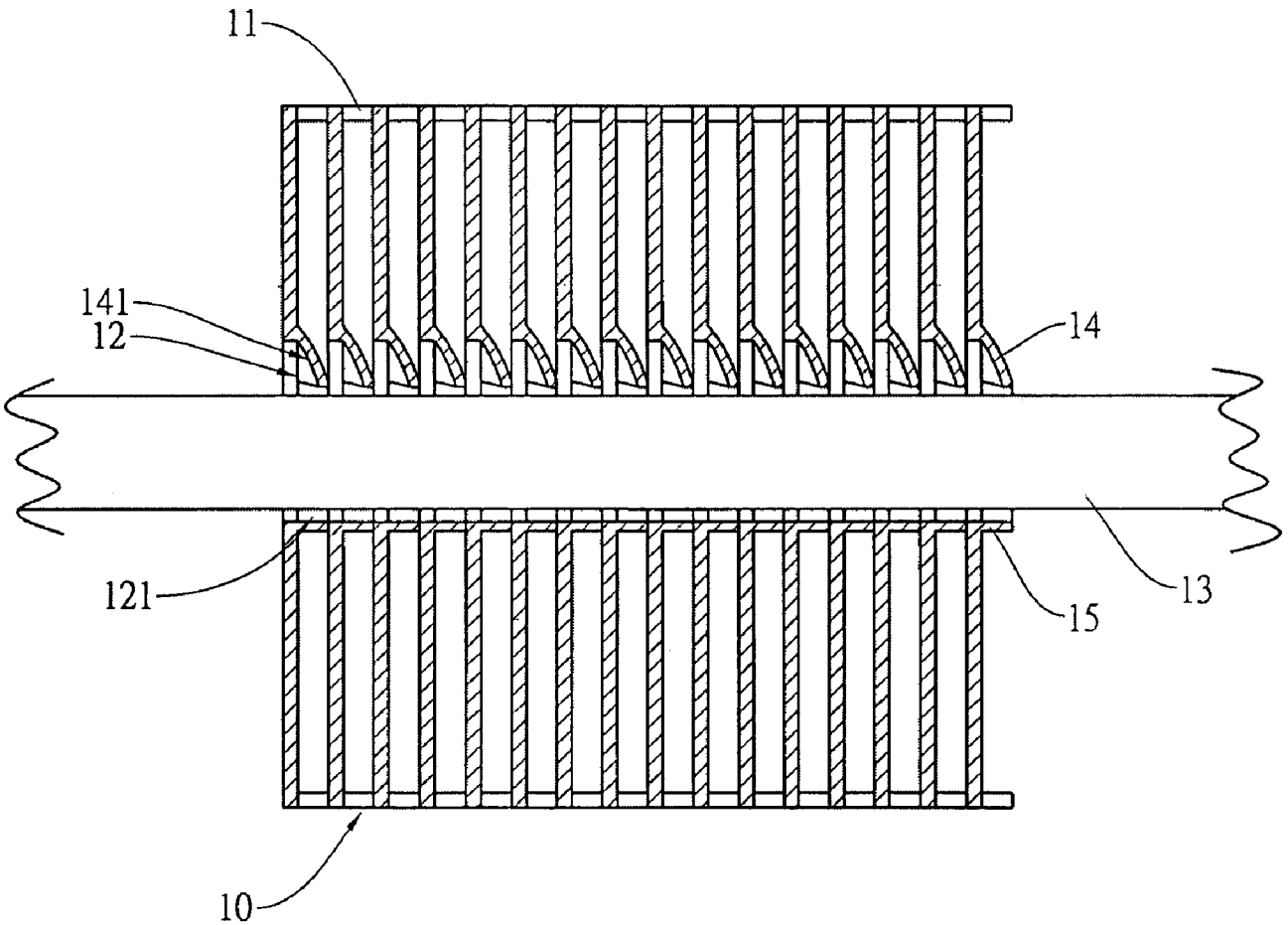
FIG. 4 is a sectional view of the cooling fin unit of the present invention with the heat guide pipe.
Figure 5:
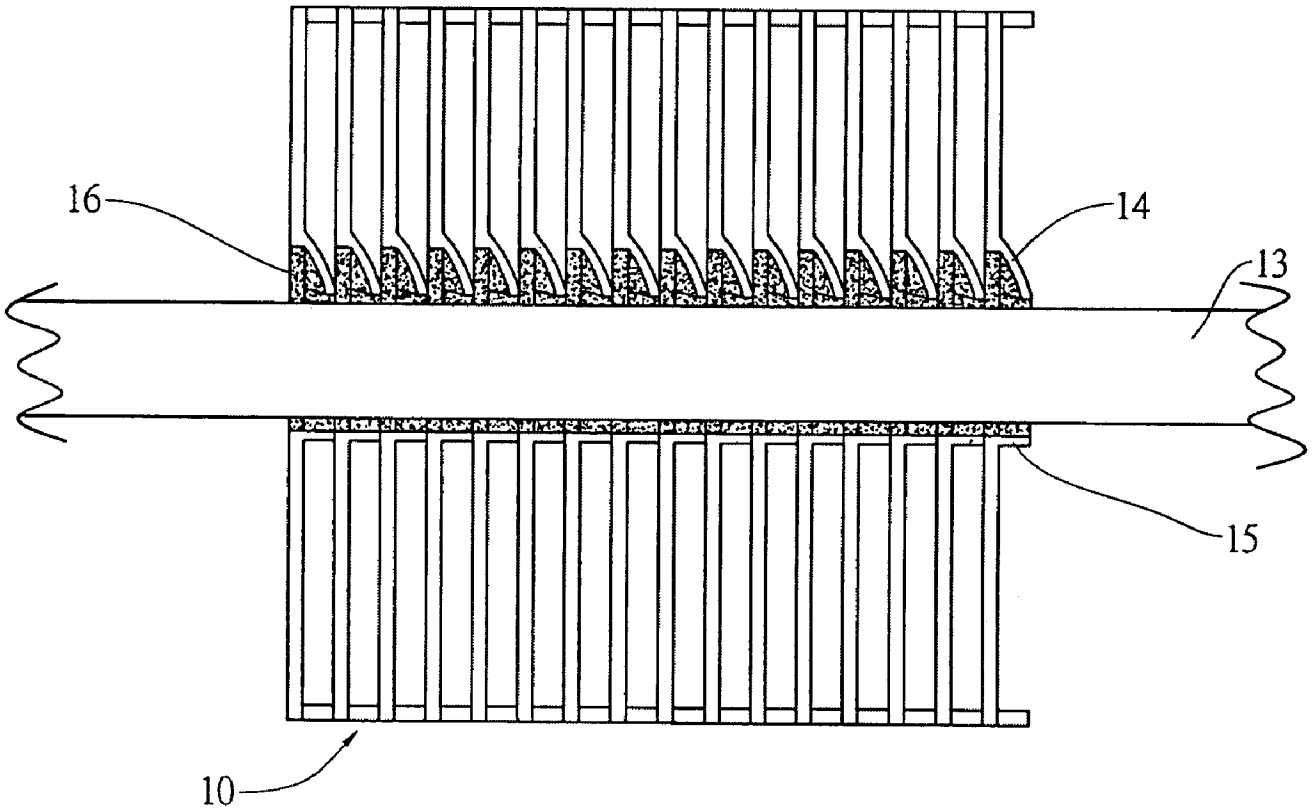
FIG. 5 is a sectional view illustrating heat conductive medium filling with the cooling fin unit shown in FIG. 4.

Referring to FIGS. 1 to 3, a preferred embodiment of a cooling fin unit according to the present invention includes a cooling fin set 10, which is formed by way of a plurality of stacked cooling fins 11. Each of the cooling fins 11 at least has a through hole 12 at the main body thereof. At least a heat guide pipe 13 passes through the cooling set 10 via the through hole 12 respectively. At least a recess part 14 indents toward a side of the main body of the respective cooling fin 11 and a receiving space 141 is formed with the recess part 14. The recess part 14 communicates with through hole 12 and a circular folded edge 15 surrounds the through hole 12 and extends outward.

The recess part 14 shown in the figures provides a sharp cone shape but it can be any other shapes such as ellipse or square. The recess part 14 receives a heat conductive medium 16 in the receiving space 14 and the heat conductive medium 16 is soldering paste or any other binding agent.

The cooling fins 11 loosely fit with the heat guide pipe 13 and the inner wall of the through hole 12 is greater than the outer surface of the heat guide pipe 13 such that a clearance 121 is provided between the folded edge 15 and the outer surface of the heat guide pipe 13.

The cooling fins 11 is capable of joining with heat guide pipe 13 firmly by way of heating up the heat conductive medium 16 to a state of melting such that the molten heat conductive medium 16 flows between the inner wall surface and the outer surface of the heat guide pipe 13 and fills with the clearance 121 for binding the respective cooling fin 11 and the heat guide pipe 13 together.

It is appreciated that the cooling fin unit according to the present invention provides the heat guide medium 16 being placed in the receiving space 141 in advance and the receiving space 141 is disposed next to the outer side of the through hole 12 so that the heat conductive medium 16 is incapable of being squeezed in case of the heat guide pipe 13 passing through the through hole 12. In this way, the heat conductive medium 16 stays in the receiving space 141 for being molten and filling with the clearance between the through hole 12 of each cooling fin 11 and the outer surface of the heat guide pipe 13 and the deficiency of the prior art is overcome completely.

While the invention has been described with referencing to preferred embodiments thereof, it is to be understood that modifications or variations may be easily made without departing from the spirit of this invention, which is defined by the appended claims.

What is claimed is:

1. A cooling fin unit, comprising:

a plurality of cooling fins being stacked to each other as a unit, each of the cooling fins at least providing a through hole penetrating a main body thereof with a folded circular edge extending outward from the circumference of the through hole; and a heat guide pipe providing an outer diameter less than an inner diameter of the through hole and passing through the through hole respectively;

characterized in that at least a local recess part is provided at the main body to make a dent from a facial side of the main body to another facial side of the main body near the circumference of the through hole such that a receiving space is formed to communicate with the through hole and a heat conductive medium is received in the receiving space for joining the cooling fins to the heat guide pipe firmly by way of the heat conductive medium being heated up to a melting state to spread allover a clearance between the through hole and heat guide pipe and then solidifying afterward.

* * * * *